US006789935B2

(12) United States Patent
Binder et al.

(10) Patent No.: US 6,789,935 B2
(45) Date of Patent: Sep. 14, 2004

(54) METHOD FOR VERTICAL MIXING AND DEVICE FOR THIS

(75) Inventors: Heinz Binder, Niederuzwil (CH); Andrea Hermsmeyer, Constance (DE); Philipp Hanimann, St. Gallen (CH)

(73) Assignee: Buhler Ag, Uzwil (CH)

( * ) Notice: Subject to any disclaimer, the term of this patent is extended or adjusted under 35 U.S.C. 154(b) by 0 days.

(21) Appl. No.: 09/973,811

(22) Filed: Oct. 11, 2001

(65) Prior Publication Data

US 2003/0072215 A1 Apr. 17, 2003

(51) Int. Cl.[7] ..... B01F 7/16

(52) U.S. Cl. ..... 366/193; 366/194; 366/195; 366/348

(58) Field of Search ..... 366/193, 603, 366/189, 192, 194, 132, 153.1, 150.1, 196, 195; 222/239, 237, 303, 359, 367

(56) References Cited

U.S. PATENT DOCUMENTS

| | | | | | |
|---|---|---|---|---|---|
| 133,911 | A | * | 12/1872 | Wilson | 222/239 |
| 784,598 | A | * | 3/1905 | Stevens | 366/194 |
| 817,727 | A | * | 4/1906 | Sletto | 222/236 |
| 875,948 | A | * | 1/1908 | Racouillat et al. | 222/239 |
| 1,204,111 | A | * | 11/1916 | Anderson | 222/239 |
| 1,496,807 | A | * | 6/1924 | Bullock | 366/193 |
| 1,639,370 | A | * | 8/1927 | Flegel | 222/239 |
| 1,653,281 | A | * | 12/1927 | Hess | 366/193 |
| 1,968,994 | A | * | 8/1934 | Davies | 366/193 |
| 2,503,878 | A | * | 4/1950 | Linn | 222/239 |
| 2,795,358 | A | * | 6/1957 | Saxlund | 222/239 |
| 2,959,893 | A | * | 11/1960 | Harmos et al. | 222/239 |
| 3,075,363 | A | * | 1/1963 | Conto | 222/239 |
| 3,129,846 | A | * | 4/1964 | Van Der Lely et al. | 222/236 |
| 3,415,494 | A | | 12/1968 | Fisher et al. | |
| 3,709,664 | A | * | 1/1973 | Krekeler et al. | 366/192 |
| 3,845,905 | A | | 11/1974 | Haslberger | |
| 4,125,063 | A | * | 11/1978 | Jelks | 366/603 |
| 4,155,657 | A | | 5/1979 | King et al. | |
| 4,376,515 | A | * | 3/1983 | Soe | 366/196 |
| 4,479,721 | A | | 10/1984 | Rieger | |
| 4,616,785 | A | | 10/1986 | Artiano | |
| 4,854,715 | A | * | 8/1989 | Eirich et al. | 366/189 |
| 5,324,142 | A | * | 6/1994 | Haig | 406/66 |
| 5,348,195 | A | * | 9/1994 | Pajot | 222/236 |
| 6,123,486 | A | * | 9/2000 | Wilms et al. | 222/237 |
| 6,126,307 | A | * | 10/2000 | Black et al. | 366/192 |

FOREIGN PATENT DOCUMENTS

| | | | |
|---|---|---|---|
| DE | 19 10 723 | | 2/1965 |
| DE | 1 557 052 | | 9/1969 |
| DE | 41 27 873 | A1 | 2/1993 |
| DE | 44 15 384 | A1 | 11/1995 |
| EP | 0 806 282 | A1 | 5/1997 |
| EP | 0 780 510 | A2 | 6/1997 |
| FR | 2678912 | * | 1/1993 |

* cited by examiner

*Primary Examiner*—Tony G. Soohoo
(74) *Attorney, Agent, or Firm*—Burns, Doane, Swecker & Mathis, L.L.P.

(57) ABSTRACT

The invention relates to a method for the vertical mixing of gaseous, liquid, powdery and/or pasty products using, for example, a hollow shaft and inner shaft arranged in a housing, whereby paddle-shaped mixing tools are provided on the hollow shaft and on the inner shaft there is provided a discharge device arranged below an outlet of the mixer. The mixer is thereby completely filled in the operating state and the product and additives are pressed onto the inner wall of the housing by means of the mixing tools. The product flows continuously downwards under the force of gravity and acts against the partly backward-conveying paddles. The continuous product flow is regulated using a rotary slide valve provided at the outlet. The mixer is especially suitable as a dosing device and/or for lubricating extruder and/or expander products.

16 Claims, 2 Drawing Sheets

METHOD FOR VERTICAL MIXING AND DEVICE FOR THIS

BACKGROUND OF THE INVENTION

The invention relates to a method for the vertical mixing of liquid, gaseous, powdery and/or pasty products with a mixing tool provided in a housing, with at least one inlet for the products to be mixed, with at least one outlet and with at least one drive.

Such mixing methods or devices are used for example in the feedstuffs industry. They are used in particular to mix together, gaseous, liquid, granular, powdery, floury and/or pasty materials of various viscosity, in particular various types of feedstuffs, to which molasses, fat etc are added.

A mixer of this type is already known from U.S. Pat. No. 3,415,494. There is described a vertical mixer with a housing and mixing organ provided with paddles. The product to be mixed is added to the mixer from above and after the batch-wise mixing process is discharged at the bottom to the side.

Depending on the type of products to be mixed, a high energy requirement can be incurred with the mixers known so far. In addition, some blocking of the machines must be anticipated. Besides, the optimal mixing in of liquids in the mixer cannot be achieved because of the different degree of filling.

The problem for the invention is therefore to propose a method and a device with which the mixing process takes place with the lowest energy requirement, there is optimal mixing with the addition of liquids of various viscosity and batchless, i.e. continuous, mixing.

The problem is solved according to the invention by a method in which the mixer is completely filled in the operating state, the mixing product is pressed by means of at least one mixing tool (at least one of which is backward-conveying) on the one hand in the direction of the inner wall of the housing and on the other hand is conveyed upwards, the mixing product is continuously conveyed downwards by means of the necessary product column above the mixing tool and in this way a shear field is built up by the mixing tools (alternatively or additionally the product pressure can also be built up by means of an (additional) pressure device), the product flow takes place continuously from the inlets of the products to be mixed as far as the outlet of the product to be mixed, whereby the initial products are fed continuously into the mixer and the flow of initial products can be regulated in a dosed fashion by means of a product discharge device provided at the outlet.

An important advantage of the method according to the invention is that the products to be mixed are hygienised by the addition of steam.

Furthermore, the problem is solved by a device which is characterised by the fact that there is provided at least one mixing tool on a rotating shaft and a product discharge device provided at the outlet.

The operating principle of the mixer according to the invention is that said mixer works with the complete product flow, i.e., the inner area of the mixer is always completely full. The mixing product to be mixed which enters the region of the mixing tools, is set in rotary motion and pressed towards the inner wall of the mixer housing whereby, for example, paddles of the mixing tool are set at least partly for backwards conveyance, i.e., in the direction opposite to the product flow, so that a shear field builds up. The gaseous, liquid or pasty additives are fed in above the first (in the product stream seen from above) for example, paddle-shaped mixing tools or at the level of said tools and are mixed with the mixing product in the direction of rotation. As a result of the velocity differential of the individual particles, which varies from the inside outwards, the liquid stream is torn apart and mixing begins. Hereby an increase in density takes place in the direction of the housing wall. The build-up of a shear field as a result of the forward conveyance or by the force of gravity (of the product) and the backward conveyance (of the mixing tools) can also act favourably.

The gaseous, liquid or pasty additives are continuously fed into the product since the inner area of the mixer is always filled. At the same time the throughput is regulated with the product discharge device provided. Thus, a continuous, i.e, dosable mixing process is ensured. Self-dosing is thereby made possible. Steam can be added with the escape slide valve closed. The mixer can thereby be connected directly to a fodder pellet press or an expander. The product shutoff towards the top has a positive effect on the temperature. This allows high temperatures with low humidity, for example, in applications using flour. The upper part of the mixer inner area always remains filled. Another associated advantage is that any contamination of the inlet section is eliminated.

The 100% degree of filling makes it possible to use shear forces. At the same time, the product pressure from the necessary product column above the mixing tool is acting. Alternatively or additionally, the product pressure can also be built up via an additional pressure device. The product can also be conveyed by the force of gravity for backward-conveying mixing tools, i.e. paddles.

The mixer features a very simple design. The mixer is very easy to maintain. It can be opened within a few seconds. Isolation or heating can thus be achieved very easily. Beside, the mixer operates without vibration.

The advantages associated with the method and the device lie especially in the fact that it operates on the run-through principle and the degree of filling is always the same. This allows better mixing of the liquids or the gases and the viscous pastes into the dry product. The mixer is less contaminated which makes cleaning very easy and a temperature recording is more accurate.

It is impossible for the machine to become blocked. Also the energy requirement is substantially reduced compared with state-of the art mixers.

Moreover, there are considerable advantages in the application of the mixer according to the invention with fodder pellet presses, expanders or batch mixers.

The mixer can be supplied from several silo compartments. The fodder pellet press or the expander can be controlled dependent on load. As a result of the exact determination of temperature in the mixer, the fodder pellet press or the expander can be driven with preset rated temperatures. Dosing with frequency control is eliminated. In addition, when using this mixer according to the invention there is no sticking near the inlet of the fodder pellet press or the expander. If the fodder pellet press should clog up, it is possible to continue directly without emptying the mixer. In particular when molasses are added, whereby even cold molasses can be used, little sticking or clumping occurs.

Moreover, the mixing method according to the invention also allows liquids to be added after the mixer. No dosing is required. A change in the direction of the mixing product, say from vertical to horizontal, can be achieved without any problem. No unmixing takes place during the run-out. Any formation of lumps is avoided. Besides, all applications of the mixer according to the invention are feasible, such as for example, its use as a dosing device, the addition of the mixing product to warm flour, as well as the addition of fat or liquids to pellets after a fodder pellet press.

BRIEF DESCRIPTION OF THE DRAWINGS

A preferred embodiment of the invention is shown in the drawing.

DETAILED DESCRIPTION OF THE PREFERRED EMBODIMENTS

Figure 1:
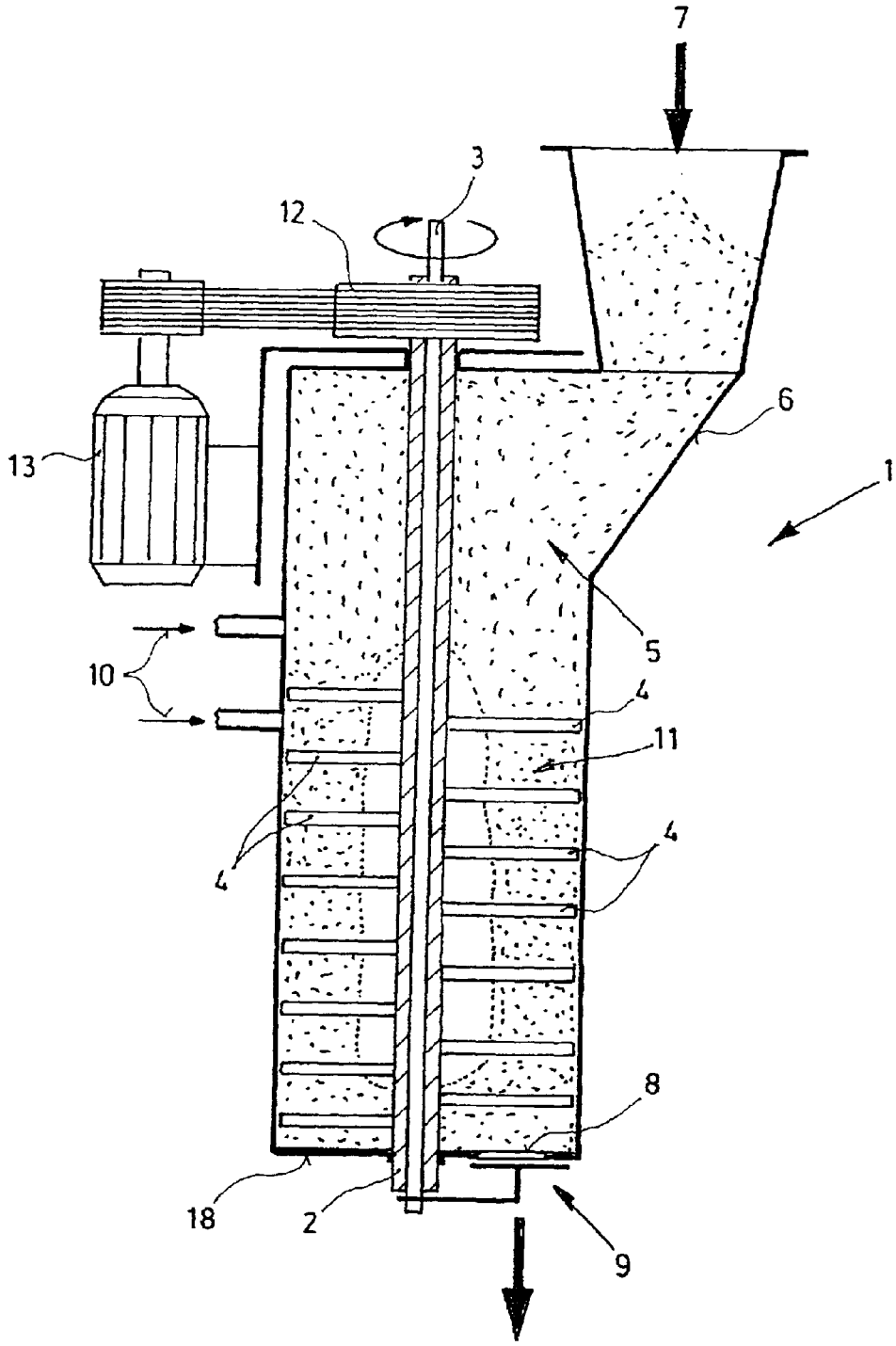
FIG. 1 is a schematic diagram of the mixer

FIG. 1 is a schematic diagram showing a section through the mixing device according to the invention. The mixer 1 comprises a housing 6 with an inlet 7 and an outlet 8. Inside the housing 8 there is provided a hollow shaft 2 in which is located another shaft 3. The paddle-shaped mixing tools 4 are attached to the hollow shaft 2. The hollow shaft 2 and the inner shaft 3 are driven by means of a drive 13 via a belt overdrive 12. Below the outlet 8 there is provided a rotary slide valve 9 connected to the inner shaft 3. Above and in the region of the paddle-shaped mixing tools 4 there are provided addition points 10 for gases, liquids and/or pasty products. In the operating state of the mixer the inner area 5 is filled to the top with product so that the products fed in via the addition points 10, e.g. molasses, water and/or steam can be fed directly into the product 11. The product to be mixed is pressed by the paddles towards the wall. Besides, the paddles are partly set to backward conveyance, i.e., in the opposite direction to the product flow.

Figure 2:
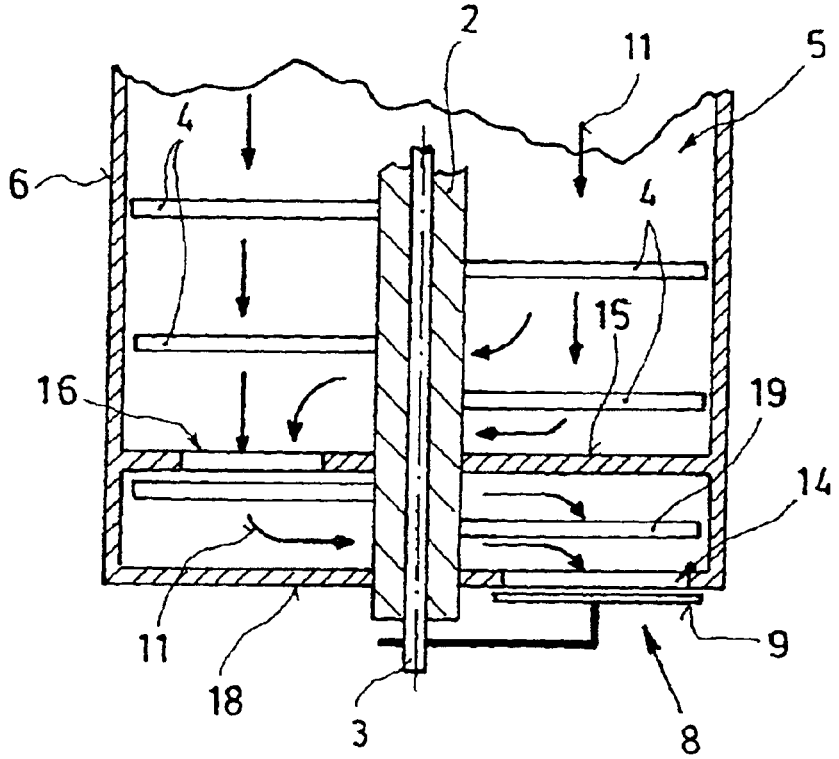
FIG. 2 is the lower part of the mixer

FIG. 2 shows the lower part of the mixer in another preferred embodiment. The notation is the same as in FIG. 1. At the bottom of the mixer housing 6 there is provided an opening 14 which is closed or opened by the rotary slide valve depending on the required dosing. Hereby the rotary slide valve 9 which is provided on the inner shaft 3 can be connected to the hollow shaft 2 via a belt overdrive 12 (see FIG. 1) for rpm-dependent regulation of the dosing or it can be driven separately. The separate drive of the inner shaft 3 with the rotary slide valve 9 is not shown in the drawing. Above the opening 14 there is provided an intermediate floor 15 inside the housing 6, which blocks off the opening 14 upward from the through-flowing product. The intermediate floor 15 has an opening 16 opposite to the opening 14. Preferably discharge tools 19 are provided between the intermediate floor 15 and the floor 18.

The speed range of the mixer is 200 rpm to 1000 rpm, preferably approx. 250 rpm.

What is claimed is:

1. A method for driving a vertical mixer with at least one rotatable mixing tool provided in a housing, with at least one inlet for a product to be mixed, with at least one outlet and with at least one drive, comprising:

continuously completely filling the vertical mixer in an operating state, the filling of the vertical mixer including supplying of an additive to the product at an input located between the inlet and the outlet, a shear field being built-up in the product by the mixing tool; and establishing continuous product flow from the inlet of the product to be mixed as far as the outlet of the product to be mixed, such that a primary product is fed continuously into the vertical mixer and the flow of the primary product can be regulated in a dosed fashion at the outlet.

2. A method according to claim 1, comprising:

adjusting the mixing tool at least partly to backward conveyance in an opposite direction to the product flow.

3. A method according to claim 2, comprising:

using the vertical mixer as a dosing device.

4. A method according to claim 2, comprising:

inserting directly after the mixer at least one of an extruder, forage pellet press, an expander and a batch mixer.

5. A method according to claim 1, comprising:

using the vertical mixer as a dosing device.

6. A method according to claim 5, comprising:

inserting directly after the mixer an extruder, forage pellet press, an expander and a batch mixer.

7. A method according to claim 1, comprising:

inserting directly after the vertical mixer at least one of an extruder, forage pellet press, an expander, and a batch mixer.

8. A method according to claim 1, comprising:

pressing the product by means of the mixing tool in a direction of an inner wall of the housing.

9. A method according to claim 1, wherein the method is used to drive at least one of a vapor, liquid, powdery and pasty product.

10. A device for driving a vertical mixer comprising:

at least one rotatable mixing tool provided in a housing for building up a shear field in the product during an operating state;

at least one inlet for a product to be mixed;

at least one outlet means for regulating flow of a primary product in a dosed fashion when continuous product flow is established from the inlet to the outlet using the mixing tool; and at least one drive for the mixing tool, the mixing tool being arranged on a shaft and a product discharge device being provided at the outlet, wherein the mixing tool is provided with paddles arranged on a hollow shaft, and inside the hollow shaft there is an inner shaft for a rotary slide valve produced at the outlet.

11. A device according to claim 10, wherein the drive is connected to the hollow shaft and to the inner shaft of the rotary slide valve via adjustable gearing or the inner shaft with the rotary slide valve is driven separately.

12. A device according to claim 10, comprising, above an opening of the outlet in a housing floor, an intermediate floor provided with an opening, whereby the intermediate floor blocks off a cross-section of the opening of the outlet to divert the product.

13. A device according to claim 10, wherein the vertical mixer has additional points for gaseous, liquid, powdery or pasty additives.

14. A device for driving a vertical mixer comprising:

at least one rotatable mixing tool provided in a housing for building up a shear field in the product during an operating state;

at least one inlet for a product to be mixed;

at least one outlet for regulating flow of a primary product in a dosed fashion when continuous product flow is established from the inlet to the outlet using the mixing tool;

at least one drive for the mixing tool, the mixing tool being arranged on a shaft and a product discharge device being provided at the outlet;

above an opening of the outlet in a housing floor, an intermediate floor provided with an opening, whereby the intermediate floor blocks off a cross-section of the opening of the outlet to divert the product in the dosed fashion; and at least one additional input located between the inlet and the intermediate floor for supplying an additive to the product to be mixed by the mixing tool.

15. A device for driving a vertical mixer comprising:

at least one rotatable mixing tool provided in a housing for building up a shear field in the product during an operating state;

at least one inlet for a product to be mixed;

at least one outlet means for regulating flow of a primary product in a dosed fashion when continuous product flow is established from the inlet to the outlet using the mixing tool;

at least one drive for the mixing tool, the mixing tool being arranged on a shaft and a product discharge device being provided at the outlet;

at least one additional input located between the inlet and the outlet for supplying an additive to the product to be mixed by the rotatable mixing tool.

16. A device according to claim 15, wherein the vertical mixer has additional points for gaseous, liquid, powdery or pasty additives.

* * * * *

UNITED STATES PATENT AND TRADEMARK OFFICE

CERTIFICATE OF CORRECTION

PATENT NO. : 6,789,935 B2
DATED : September 14, 2004
INVENTOR(S) : Heinz Binder et al.

It is certified that error appears in the above-identified patent and that said Letters Patent is hereby corrected as shown below:

Title page,
Item [75], Inventors, "Andrea Hermsmeyer, Constance (DE)" should read -- Andrea Hermsmeyer, Konstanz (DE) --.

Signed and Sealed this

Fifteenth Day of February, 2005

JON W. DUDAS
*Director of the United States Patent and Trademark Office*